United States Patent [19]

Boyson et al.

[11] 4,250,806

[45] Feb. 17, 1981

[54] COMPUTER CONTROLLED INSPECTOR/PRINTER DOCUMENT INSPECTION

[75] Inventors: Bert Boyson, Englewood, N.J.; Terence J. Gallagher, Brookfield; William E. Porsche, Ridgefield, both of Conn.

[73] Assignee: The Perkin-Elmer Corporation, Norwalk, Conn.

[21] Appl. No.: 964,108

[22] Filed: Nov. 27, 1978

[51] Int. Cl.³ ..... B44B 5/00; B41F 33/16

[52] U.S. Cl. ..... 101/2; 101/86; 209/553

[58] Field of Search ..... 101/2, 86, 77; 209/10, 209/553, 656

[56] References Cited

U.S. PATENT DOCUMENTS

| | | | |
|---|---|---|---|
| 2,528,123 | 10/1950 | Dyken | 101/2 |
| 2,624,273 | 1/1953 | Wheeler | 101/2 |
| 2,997,173 | 8/1961 | Nelson et al. | 209/553 |
| 3,023,895 | 3/1962 | Nelson et al. | 209/553 |
| 3,073,445 | 1/1963 | Holt et al. | 209/553 |
| 3,362,323 | 1/1968 | Wada et al. | 101/2 |
| 3,641,931 | 2/1972 | Hickox et al. | 101/2 X |
| 3,995,545 | 12/1976 | Romeo et al. | 101/2 X |
| 4,027,585 | 6/1977 | Goldman | 101/86 X |

*Primary Examiner*—Edward M. Coven

*Attorney, Agent, or Firm*—Salvatore A. Giarratana; Francis L. Masselle; Edwin T. Grimes

[57] ABSTRACT

A document processor for transporting documents through a path, detecting flaws thereon by electronically scanning each side of the document, printing selectable indicia only on unflawed documents, and sorting and storing separately the flawed and unflawed documents. The electronically scanned information is compared with a master document stored in a computer memory. As a result of this comparison, outputs are provided from the computer which are indicative of a favorable or unfavorable comparison for controlling the printing and sorting functions.

5 Claims, 6 Drawing Figures

COMPUTER CONTROLLED INSPECTOR/PRINTER DOCUMENT INSPECTION

BACKGROUND OF THE INVENTION

The production of documents such as checks, bank drafts, traveler's checks, currency and the like has special problems associated therewith not normally associated with the production of ordinary printed matter. For example, such documents are prone to unlawful duplication or counterfeiting. Therefore, in order to eliminate or minimize such unlawful acts, the documents are printed using special paper, special inks, and in highly sophisticated and complex patterns.

In addition, security requirements dictate that each of such documents be accounted for by the printing thereon in one or more areas data in the form of serialized numeric and/or alpha-numeric indicia. Such serialization enables the issuer of such documents to maintain a record as to what documents are in circulation. In the case of traveler's checks the issuer has a means of maintaining a record of the precise checks which have been issued to particular customers. Thus, checks that are lost or stolen are easily replaceable and counterfeit or unlawfully duplicated checks are easily identifiable.

Also for various reasons, for example, aesthetics, guaranty of authenticity of origin and genuineness of the document, it is desirable that such documents meet certain quality standards. Thus, much effort is expended by the various agencies and businesses issuing such documents to assure the release of only those documents which meet predetermined quality criteria. Thus, governments issuing currency and businesses issuing documents such as traveler's checks expend great effort to prevent the issuance of flawed or imperfect documents.

Presently known methods of accomplishing the aforegoing, for example, in currency or traveler's check production require that each document be visually inspected for flaws by a human inspector. In practice, the documents are printed in sheets of, for example $8\times4$ documents with each sheet containing 32 documents. Each document is printed with serialized indicia. If all the documents pass the visual inspection for quality, the sheets are cut into individual documents and stacked sequentially according to their serial number.

On the other hand, when visual inspection uncovers one or more flawed documents, the documents are rejected. However, in order that consecutive serialization be maintained, the rejected documents must be replaced with documents previously printed save for the serial numbers. These documents then have the appropriate serial numbers printed thereon and manually placed in correct sequential order.

As can be readily appreciated, the foregoing described procedure of inspection and replacement of rejected documents is time consuming, prone to human error, and costly.

The present invention relates to an apparatus wherein the foregoing procedure of inspection and printing serial numbers is fully automated.

SUMMARY OF THE INVENTION

The present invention relates to an apparatus that eliminates the disadvantages of the foregoing described procedure by completely automating the process of flaw detection and number serialization of the documents. Specifically, the present invention comtemplates an apparatus for processing documents such as currency, checks and travelers checks which are completely printed save for serial numbers. A document processor is provided wherein the documents are individually transported through a work path having disposed adjacent thereto electronic flaw detectors for the detection of flaws on the front and back of the documents, one or more printers for printing serial numbers in sequence in one or more areas of the document as well as other desired indicia only on unflawed documents, a reader-verifier for checking the readability and accuracy of the printed indicia, a sorter arrangement for separating and storing the serialized, unflawed documents and the unserialized, flawed documents.

The flaw detector includes optical electronic scanners. Associated with the flaw detectors are means for converting the scanned information into digital form, and comparing the scanned information with a master document stored in a computer memory to provide outputs for controlling the printer and the sorter based on whether the document is flawed or unflawed.

DRAWINGS

The foregoing features as well as other features of the invention will become more apparent with the reading of the following description in conjunction with the drawings wherein.

DESCRIPTION

Figure 1:
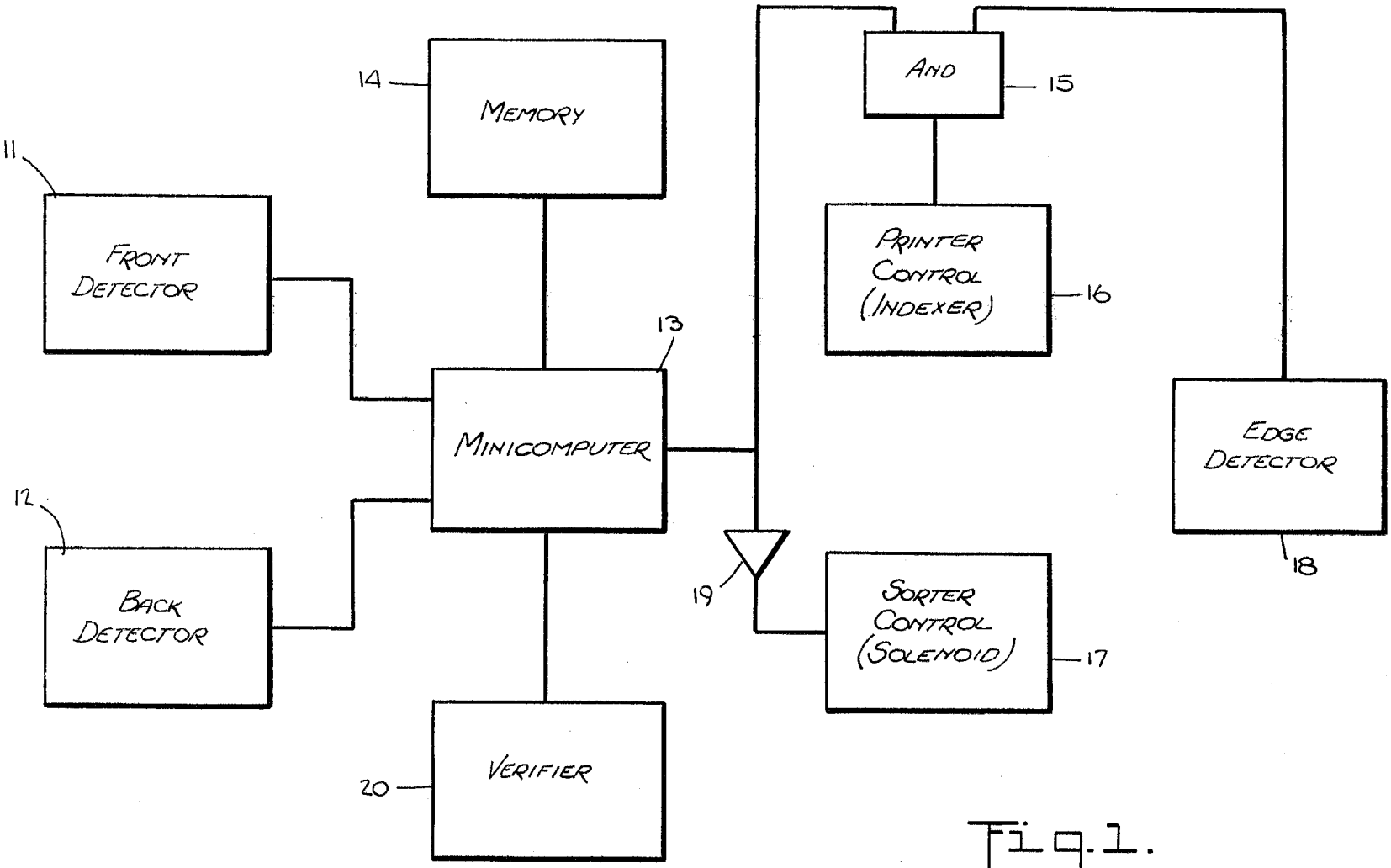
FIG. 1 is a block diagram of the control arrangement of the present invention.

Referring now to FIG. 1, there is shown in block diagram form the control arrangement of the inspector, printer, sorter of the present invention.

As will be described in more detail below each document (hereinafter sometimes referred to as a check) to be processed is transported through a path comprising inspection stations, printers stations, and verifier/sorter station.

The inspection stations comprise front detector 11 and back detector 12 which optically scan the front and back of the checks. The detectors 11 and 12 may comprise solid silicon detector arrays and are sensitive to gradations of light reflections of a light source impinging on the test checks. Each check comprises a plurality of scan lines which run along the length of the checks perpendicular to the direction of motion of the checks. Each scan line is divided into a plurality of small picture areas sometimes referred to as pixels. In a manner well known, for example, as disclosed in U.S. application Ser. No. 954,018 entitled Optical Inspection System For Printing Flaw Detection filed on Oct. 23, 1978, having the same assignee as the present application, each scan line is optically examined by the detectors 11 and 12 and on a pixel by pixel basis each scan line is compared to a master check stored in a memory. Depending on a quality criteria adopted for the comparison there is produced an output for each check indicative of its acceptability or unacceptability.

The front and back detectors 11 and 12 whose information is digitized in a manner described in the above identified application have their outputs connected to a mini computer 13 which is shown as having an input from memory 14. Memory 14 stores the master check which is read out therefrom into a comparator contained within minicomputer 13 in registration with the scanned data from the test check. After comparison of the test check with the master check is completed, the minicomputer 13 makes a determination whether the check is acceptable or not. For example, a positive pulse is indicative of a favorable comparison while a negative pulse is indicative of an unfavorable comparison. As aforesaid, the flaw detection arrangement is fully described in the above identified application and, per se, forms no part of the present invention.

The output of the minicomputer 13 is connected to AND circuit 15 and to inverter 19. Edge detector 18 has its output connected to AND circuit 15 whose output is connected to printer control 16. The output of inverter 19 is connected to sorter control 17.

Edge detector 18, which is disposed along the check transport path ahead of the printer stations is responsive to the leading edge of each test check to produce a positive pulse output. This positive pulse output is provided as one input to the AND GATE 15. When the microprocessor 13 has a positive pulse or high indicative of an acceptable check on its output, the printer control 16 receives a pulse via gate 15 to cause the printer or printers to index and print as will be seen more fully hereinbelow.

The sorter control 17 which is responsive to positive pulses is not activated by the high or positive pulse from the minicomputer 13 since this pulse is inverted by inverter 19 prior to its being provided as an input to the sorter control 17. Therefore, in the presence of an acceptable check, the sorter control, as seen more fully hereinbelow, is left inactivated thereby causing the printed check to be placed in an accept stack. On the other hand, when the minicomputer provides a low or negative pulse, the printer control 16 is prevented from indexing by the lack of an appropriate pulse from AND circuit 15 and printing on the check does not occur. At the same time the negative or low on the output of the minicomputer 13 becomes a positive pulse to the sorter control 17 and causes the unprinted or rejected check to be stacked in a reject stack.

Thus, it may be seen that only unflawed checks have serial nunbers sequentially printed thereon.

FIG. 1 also shows a verifier 20 connected to the minicomputer 13. The function of the verifier 20 which is disposed in the path of accepted checks is to confirm the readability of the numbers and that the serial numbers placed thereon are in sequential order. The verifier 20 may also be used to cause a stopping of the inspector-printer if a serial number is unreadable or is not in the correct sequence.

Figure 2:
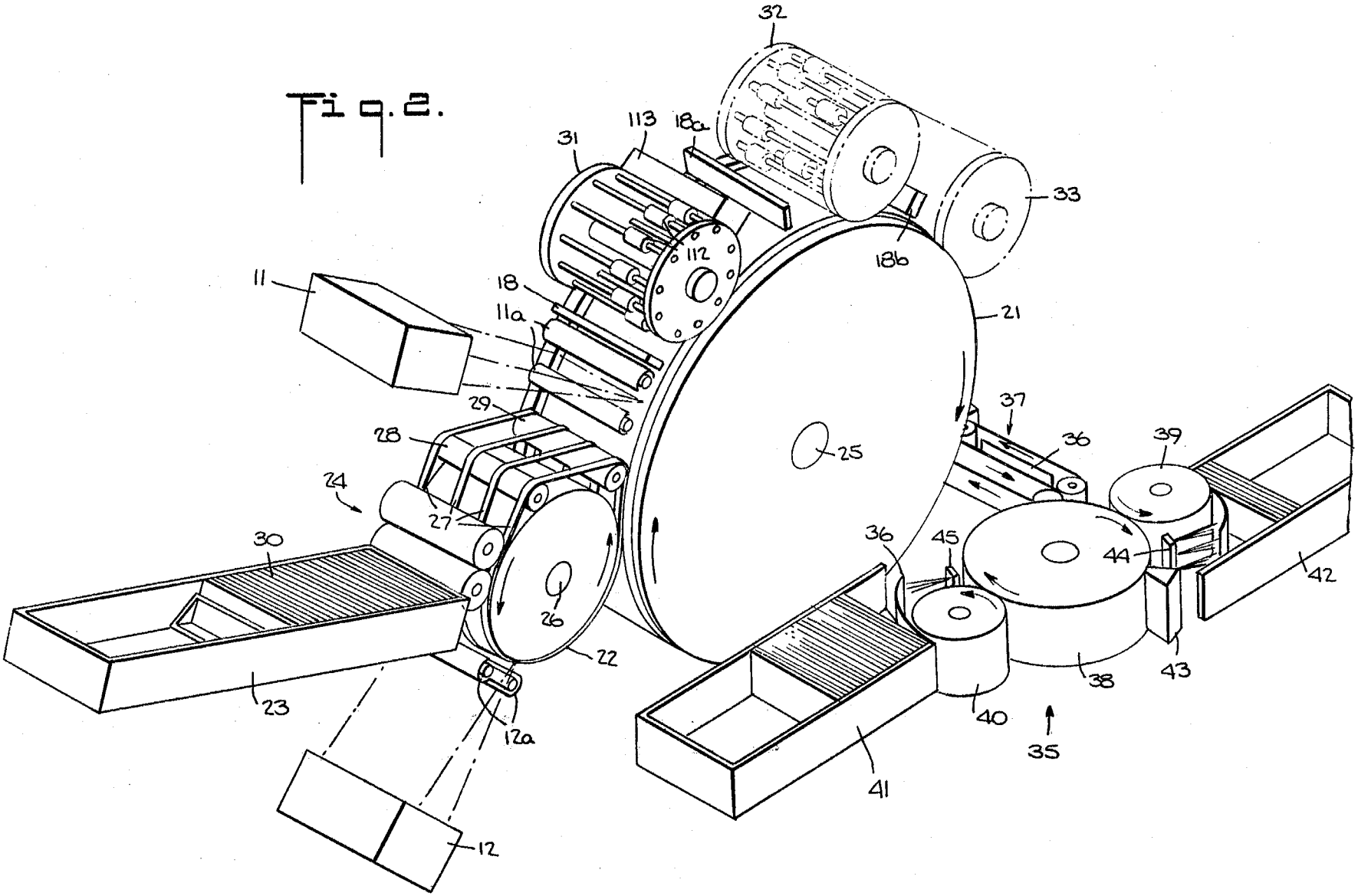
FIG. 2 is a pictorial representation of a preferred embodiment of the document processor of the present invention.

Referring to FIG. 2, there is shown in pictorial form the document processor of the present invention. The document processor of FIG. 2 comprises an apparatus for transporting checks through inspection stations, one or more printing stations, and a sorter verifier station.

It should be noted that the checks to be inspected, printed and sorted are completely preprinted save for the serial numbers and logo.

Figure 3:
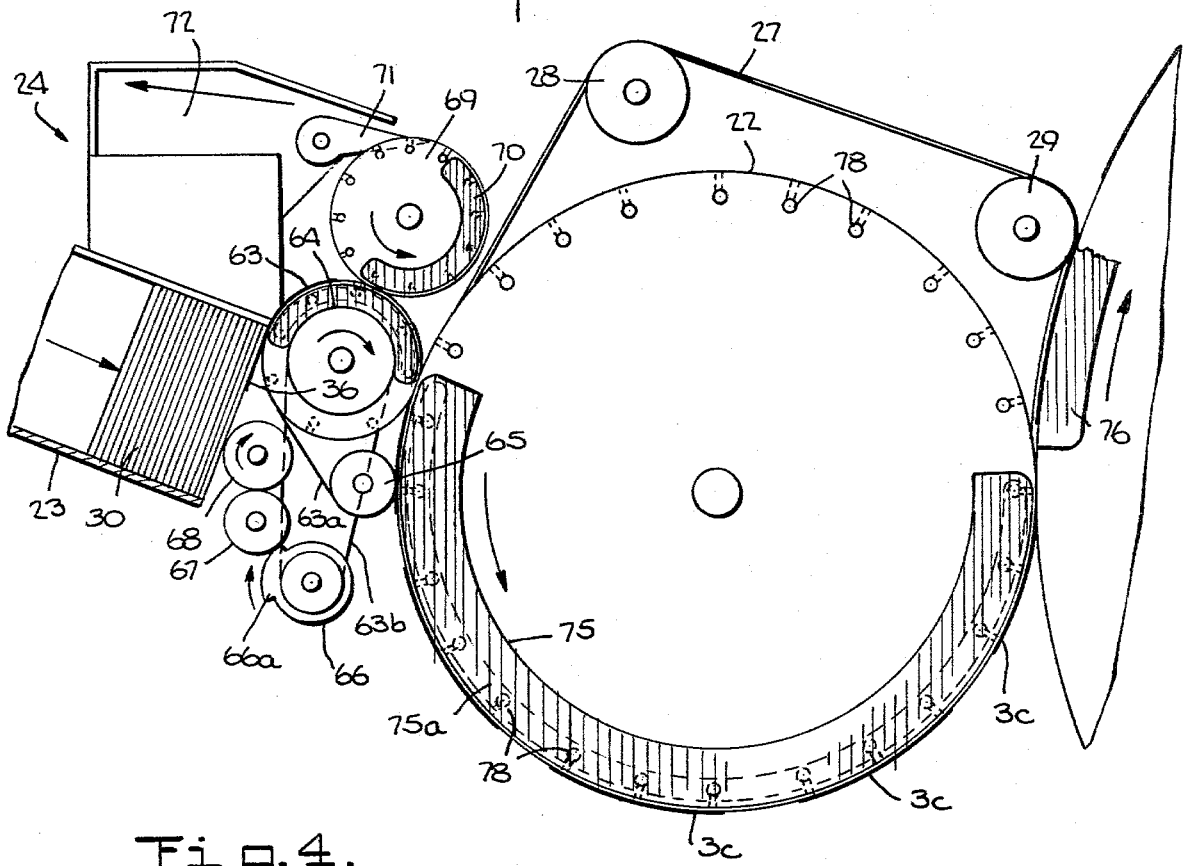
FIG. 3 is a side elevation view of the feed assembly of the present invention.

The transport system of FIG. 2 comprises an impression drum 21 mounted for rotation about an axis or shaft 25. A transfer drum 22 mounted for rotation about a shaft 26 is disposed adjacent to the impression drum 21 substantially as shown in FIG. 2. The transfer drum 22 has about a portion of its periphery a number of belts 27. The belts 27 also encompass idler pulleys 28 and 29. The transfer drum 22 and belts 27 are substantially contigious with a portion of the periphery of the impression drum 21. The belts 27 as may be deduced from the drawing aid in the transfer of a check from the transfer drum to the impression drum 21. Partially shown in FIG. 2 and shown in more detail in FIG. 3 is a check feed assembly 24 shown in close association with the transfer drum 22. Adjacent to and in operative relationship with the feed assembly 24 is a feeder tray 23 which holds a stack of checks 30 which are to be processed i.e. inspected, printed and sorted.

Still referring to FIG. 3, and as to be more fully described hereinafter, the checks 30 are picked up one by one by the feed assembly 24 and placed on the transfer drum 22, held there by vacuum and with the aid of the belts 27 transferred to the impression drum 21.

Disposed about the impression drum 21 in cooperative relationship with the periphery thereof are shown in FIG. 2 three printers 31, 32, and 33.

The printers 31, 32 and 33 are of a commercially available type, for example, as manufactured by Heller Roberts Instrument Corp. of Brooklyn, N.Y.

If the check is unflawed, printer 31 prints a serial number in, for example, the upper right hand corner is gothic letters; printer 32 prints the same serial number in MICR in the lower left hand corner, while the printer 33, if it is desired, may print the logo of the particular financial institution issuing the check. For purposes or explaining this invention is only necessary to show the one printer for example, printer 31 in some detail and in its relationship in the combination of the present invention in FIG . 2. More of the details of the printers 31, 32 and 33 are shown in FIG. 6.

Figure 6:
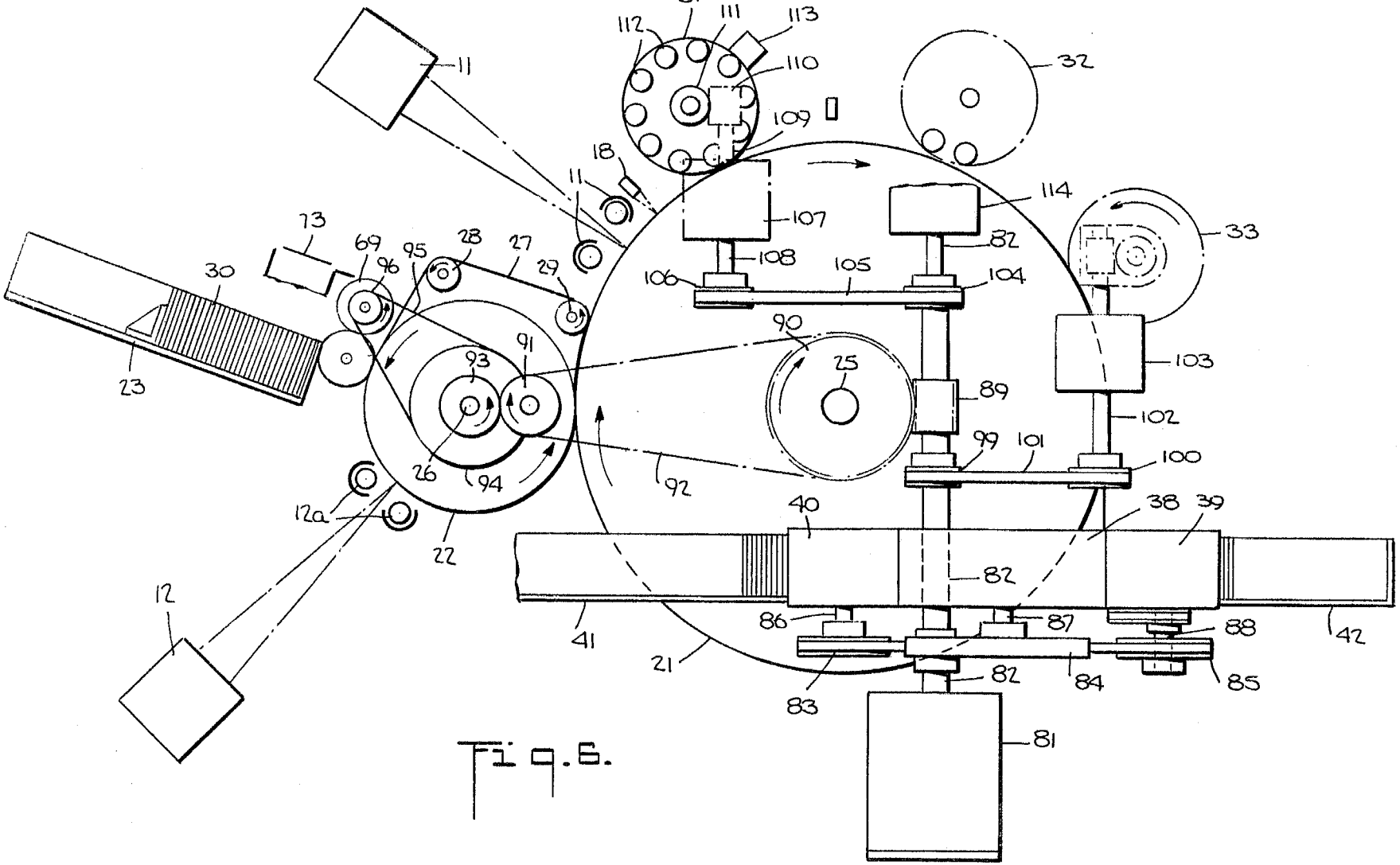
FIG. 6 is a side elevation view of FIG. 2 depicting among other things the power train for the document processor of the present invention.

As best seen in FIGS. 2 and 6, back quality inspector 12 is disposed adjacent to the transfer drum 22 for electronically scanning the back of a check 36 as it passes around the periphery of the transfer drum 22. Two light sources **12*a* which straddle the inspection area provide the required light source for back inspector 12. In a similar manner face quality inspector 11 along with light sources 11*a* are disposed adjacent the periphery of the impression drum 21 for inspecting the face of the check 36 as it is passed through the point of inspection on the impression drum 21**.

Edge detector 18 is disposed adjacent the periphery of the impression drum 11 somewhat in advance of the printer 31. Edge detector 18 detects the leading edge of each check 36. When it is determined that a check 36 has passed quality inspection and its leading edge is detected by the edge detector 18, the printer 31 is caused to be indexed to printing speed and position for printing the serial number on the check. Thus, as each unflawed check comes through, it is imprinted with a serial number in a sequential fashion i.e. each number being incremented by one.

However, if edge detector 18 does not detect an edge, due to a check being missed by the singler, the printer 31 will not be indexed. Also if the edge detector 18 detects a check but it has not passed quality inspection, the printers 31, 32 and 33 will not be indexed for printing. Thus, as described in reference to FIG. 2, two coincident events are required for printing on a check and these are edge detection and an unflawed check.

Figure 5:
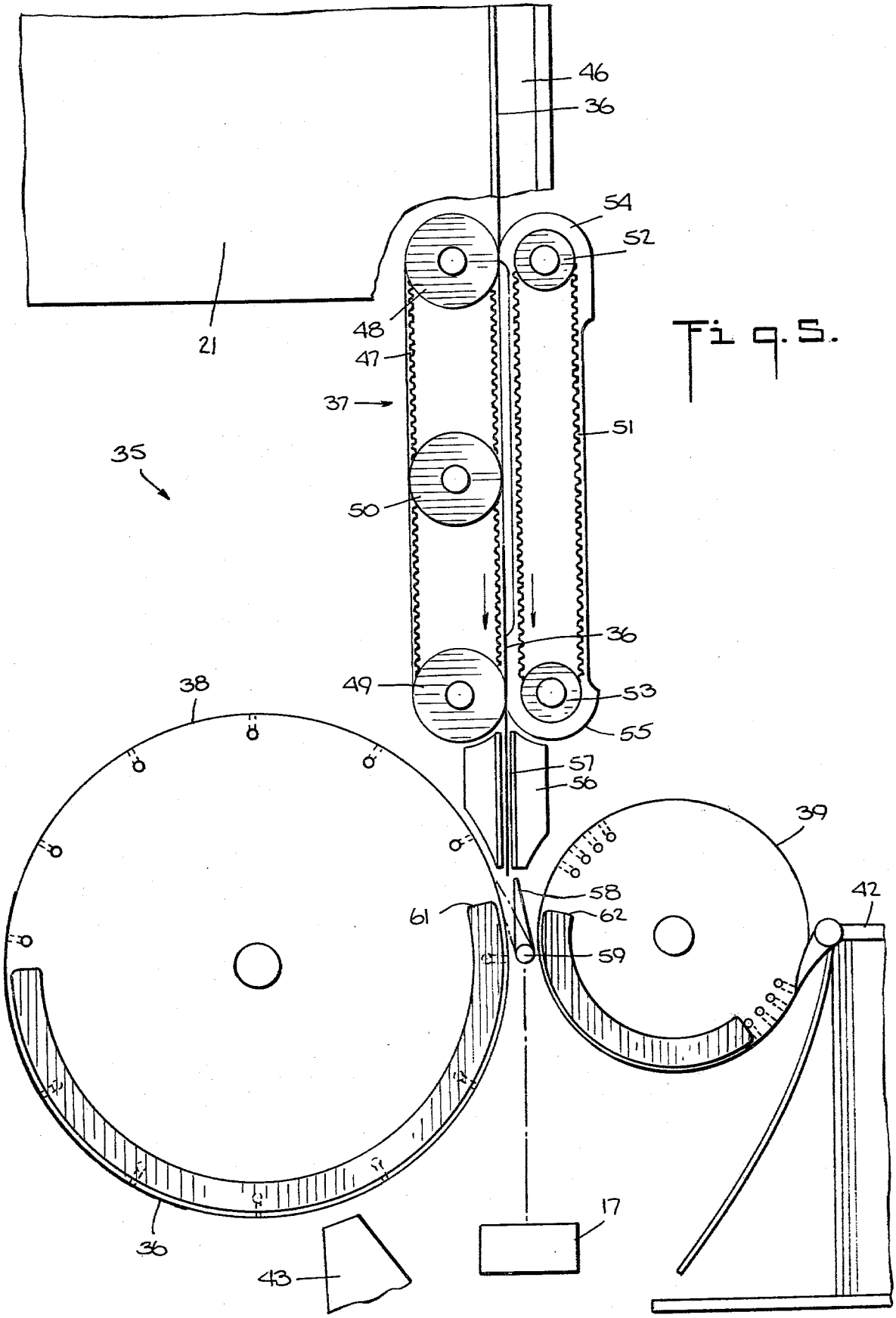
FIG. 5 is a view of the document sorter verifier partially shown in FIG. 2.

A sorter-verifier assembly 35 is shown in FIGS. 2 and 5. As more readily seen in FIG. 5, this assembly comprises a belt pick-up arrangement indicated at 37 which collects each check from the impression drum 21 and carries it away from the impression drum 21 toward a verifier drum 38. If the check 36 is unflawed and, therefore, serialized by the printers 31 and 32, it is caused to be picked up, for example, by vacuum by the verifier drum 38. The serial numbers are read by the verifier 43 which is disposed adjacent to the periphery of the verifier drum 38. Thereafter, the check follows a path around the verifier drum 38 to a vacuum drum 40 to which it is transferred. The check is separated from the drum 40 with the aid of an air jet nozzle or puffer 45 and placed in accept stacker 41, substantially as shown in FIG. 2. On the other hand, if the check does not pass quality inspection, it is caused to adhere to drum 39. After following a path partially around drum 39, it is separated therefrom by an air jet nozzle or puffer 44 and then stacked in reject stacker 42.

If the numbers printed on the check are not readable, or are not sequential as detected by the verifier 43, the document processor is shut down until the fault is corrected.

FIG . 5 shows that portion of the sorter-verifier 35 which is not readily visible in FIG. 2. A catcher or slot 46 disposed closely adjacent to the periphery of the impression drum 21 receives the checks 36 individually as they are separated from the impression drum 21 as for example, by termination of the vacuum and/or separator fingers.

The pick-up belt arrangement 37 comprises a timing belt 47 disposed about drive pulleys 48, 49 and 50. The pulley 50 is provided to minimize undue flexing of the timing belt 37. Another timing belt 51 is disposed about drive pulleys 52 and 53. Both timing belts 47 and 51 may be composed of some suitable elastomer composition. The timing belt 51 has raised cam or gripper surfaces 54 and 55 which in conjunction with belt 47 grip individual checks 36 and transport them away from the impression drum 21. The raised or cam surfaces 54 and 55 are of such a length and so spaced on the timing belt 51 that as one cam surface for example 54, as shown in the drawing, picks up a check 36 for transport, the other cam surface 55 is delivering the previously picked up check 36 to the verifier drum 38 or the reject drum 39.

Disposed near pulleys 49 and 53 and between verifier drum 38 and reject drum 39 are guide means 56 which together from a channel 57 for guiding the check 36 to verifier drum 38 or reject drum 39. A mechanical gate 58 pivoted about pin 59 is controlled by sorter control solenoid 17. When the check is unflawed the gate 59 remains in its normal position indicated by the solid lines. In this position the check 36 on being released by the cam surface 55 or 54 is directed on to verifier drum 38, held there by vacuum within plenum area indicated by reference numerical 61 for verification and subsequent stacking into the accept stacker 41.

As the check is separated from the impression cylinder 21 and falls into catcher tray 46, air jets or puffers—serve to direct the check to the rear of the tray. The grippers on the transfer belt are designed so as to grasp the check from this position, the gripper surface 54 or 55 on the belt 51 being raised much higher than its corresponding surface on belt 37. This design serves two purposes: it prevents overlap interference between succeeding checks, and it produces a slot between the transfer belts for accepting the next check.

If the check has failed to pass inspection, sorter control solenoid 17 is energized to move the gate 58 to the position shown in dotted line in FIG. 5 so that the rejected check is picked up by vacuum area 62 on the reject cylinder 39 and subsequently placed in reject stack 42. Solenoid 17 is then deenergized and mechanical gate 58 assumes its normal position as indicated by the solid line as, for example, by a return spring (not shown).

While vacuum means have been described to grip the checks in their paths about the various drums, other means are also possible. It will be appreciated that stationary plenums 61 and 62 are so placed on their respective drums that the associated vacuum picks up and lets go of the individual checks at the appropriate places in their transport path. For example, plenum 61 is placed to pick up the check 36 just after it leaves guide means 56 and let go of it just as it is picked up by a similar plenum segment (not shown) on vacuum drum 40. Separator fingers may be used to release the checks from the drums 40 and 39 in conjunction with the air jet nozzles 45 and 44.

Referring to FIG. 3 there is shown in more detail the feed assembly 24 of FIG. 2. A singler drum 63 has a stationary plenum 64 which in a manner described in more detail hereinafter with reference to the transfer drum 22 provides vacuum to the surface periphery of the singler drum 63 through the arc defined by the plenum 64. The singler drum 63 is rotated in a clockwise direction, as viewed in FIG. 3, and by means of transfer belts **63*a* rotates roller 65 also in a clockwise direction. The singler drum 63 abuts against the upper part of the check stack 30 in the feeder tray 23. A portion of the plenum 64 overlaps the upper edge of the first check 36 in the stack 30. A picker 68 is disposed to have a portion of its periphery in contiguous relationship to the first check in the stack 30. A pulley 66, driven by the singler drum 63 via a toothed timing belt 63*b* has a raised or cam surface 66*a* which intermittently rotates the picker 68 in a clockwise direction through an idler roller 67 which is disposed in contiguous relationship with the picker 68 and which is intermittently driven in the counter clockwise direction by the cam surface 66*a* of the pulley 66**.

Feeder tray 23 is disposed at an angle to the horizontal such that the stack of checks 30 rests against the picker 68 and the singler drum 63. A constant force spring such as a negator spring may be used to bias the checks in the direction of the picker 68. Each time the cam surface **66*a* rotates the picker 68, a check is caused to be fed out of the feeder tray 23 and onto the singler drum 63. At the point where the plenum 64 ends and the plenum 75 of the transfer drum 22 begins the check is picked up by the transfer drum 22. The transfer is assisted by the belts 63*a* contiguous with a portion of transfer drum 22. The check is retained on the transfer drum 22 by vacuum, in the vicinity of the stationary plenum 75 and then is transferred to the impression drum 21 by means of the belts 27 acting in concert with the vacuum provided at the surface of the impression drum 21 by the plenum 76 which begins in the vicinity of where the plenum 75** ends.

If two checks are mistakenly fed out of the feeder tray 23 by the picker 68 and begin to be transported by the singler drum 63, the doubler drum 69 which is rotating in a counter clockwise direction geared 1:1 with the singler drum and whose plenum 70 begins somewhat at the mid point of the plenum 64, picks up the extra check. The vacuum provided by plenum 70 is somewhat less than that provided by plenum 64 to insure that it will not pick up a single check from the drum 63. The check is then picked off from the doubler drum 69 by the dual action of the pick off finger 71 and the end of the plenum 70 at which point vacuum to the surface periphery of the doubler drum 69 is terminated. The check is then by momentum placed in chamber 72 where by gravity or other means it falls into a receptacle (not shown). These checks may be accumulated and placed again in the feeder tray 23 for processing.

Figure 4:
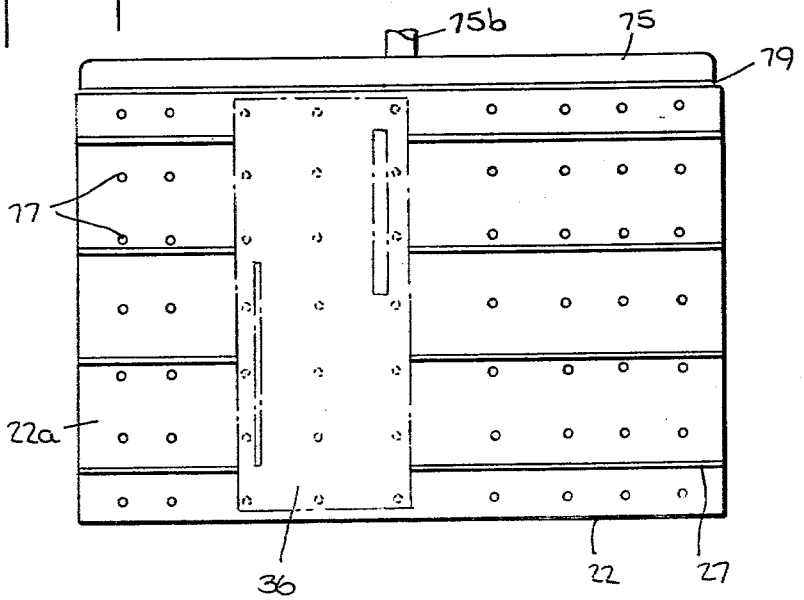
FIG. 4 is a top view of the transfer drum of the present invention.

Since in a preferred embodiment the present invention utilizes vacuum to maintain the checks on the various drums throughout its path and to cause the checks to transfer from one drum to the other, the arrangement of the stationary plenums and the manner in which vacuum is applied to the surface periphery of the drums is briefly discussed with reference to the transfer drum 22 shown in FIGS. 3 and 4, it being understood that each of the drums utilizing vacuum are constructed in the same way.

The transfer drum 22 has a plurality of bores 78 extending from one side of its periphery. Each of these bores 78 communicates with a row of holes 77 in the surface 22*a* of the transfer drum 22. Thus, when a vacuum source is connected to one bore 78 its corresponding row of holes provides vacuum at the surface 22*a* of the transfer drum 22.

The plenum 75 is stationary relative to the drum 22. A gap 79 separating the plenum 75 from the drum 22, is small enough so that it does not affect the vacuum force, but wide enough to avoid frictional rubbing with the drum 22.

The plenum 75 includes a chamber 75*a* which communicates with each bore 78. The plenum chamber 75*a* is connected to a suitable vacuum source (not shown) as by means of a tube 75*b*.

It should be noted that the vacuum arrangements not only retain each check on the various drums throughout its transport path, but also aids in the transfer of the checks from one drum to another. For example, from FIG. 3 it can be deduced that when a check reaches the end of its travel on transfer drum 22, the vacuum on the periphery of the impression drum 21 begins at a point where the check transfers to the impression drum 21 and with the aid of the belts 27 effects the transfer.

Means other than vacuum might be used to secure the checks during their transport e.g. gripper fingers or the like.

FIG. 6 is a hybrid view showing the document processor of FIG. 2 in side elevation and a power train arrangement for supplying motive power to the various drums and printers.

A motor 81 has an output shaft 82 connected via a belt arrangement to drive pulleys 83, 84 and 85 which as can be seen rotate, respectively, the accept drum 40, the verifier drum 38 and the reject drum 39 via shafts 86, 87 and 88, respectively.

The shaft 82 has disposed thereon a worm 89 which drives impression drum 21 via a worm wheel 90. The pulley portion of worm wheel 90 drives a gear-pulley 91 via belt 92 which provides motive power to the transfer drum 22 by meshing with a gear 93.

A pulley 94 drives doubler drum 69 via belt 95 and pulley 96 which in turn drives single 63 via pulley 97 and crossed belt 98.

The pulleys, gears and belts, as may be seen from the drawings are of various sizes to provide appropriate geared down or up speed ratios with the object being to drive each of the drums at identical peripheral speeds so that the check moves through its path at the same rate without regard to which particular drum on which it is momentarily riding.

The shaft 82 also has disposed thereon a pulley 99 which drives pulley 100 via belt 101. The pulley 100 drives a shaft 102 of an indexer 103 associated with the logo printer 33.

The shaft 82 directly drives the indexer 114 and via pulleys 104 and 106, belt 105 and shaft 108 drives the indexer 107.

The indexers 103, 107 and 114 are commercially available items as are the printers 31, 32 and 33.

Since the indexers and printers all function in a similar way only indexer 107 and its associated printer 31 are discussed in some detail in order to describe its cooperative relationship within the combination of the present invention.

The indexer 107 has an input shaft 108 which rotates continuously by means of pulley 106. The input shaft 108 is normally slipping in a single revolution spring wrap clutch within the indexer 107. The clutch output shaft not shown is held in the unwrap condition by a load dog which is restrained by a solenoid actuated plunger. Upon momentary actuation of the solenoid by the pulse from the AND circuit 15 of FIG. 1, the load dog is released causing the clutch to engage, thereby causing the indexer 107 to operate for one revolution or for one print cycle. The indexer 107 is internally cam programmed to cause the output shaft 109 to accelerate to print speed, remain at that speed momentarily and then to decelerate to zero speed. In the meantime the load dog has returned to its normal position causing the clutch to release the output shaft 109 when it has made one complete rotation, causing the clutch to reassume its slipping condition.

This occurs each time an unflawed check is detected by edge detector 18.

The output shaft 109 is coupled to the printer 31 by means of worm 110 disposed on shaft 109 meshing with worm wheel 111 disposed on the printer 31. Since the indexer 107 is a one revolution device and the printer 31 rotates only 1/10 revolution/cycle in the embodiment described here, a 10/1 gear reduction must be provided by the worm 110 and wheel 111.

The printer 31 comprises ten numbering cylinders 112 each displaced 36° from its adjacent cylinder. Each numbering cylinder 112 comprises a plurality of individual numbering wheels with the actual number of wheels depending on the length of the serial number to be printed on the checks. Each wheel has ten print elements equally spaced around its periphery and in raised impression for printing the nunbers 0 through 9.

Inker 113 supplies ink to each numbering cylinder 112 at a point in advance of a numbering cylinder 112 reaching the print position.

When AND circuit 15 receives its inputs from the edge detector 18 and the microprocessor 13, the indexer 107 advances the printer 31 36° to place a print cylinder 113 in print position. Due to the inherent function of the indexer 107, the print cylinder 112 accelerates to the tangential speed of impression drum 21 at the print position and prints on the check which arrives in synchronism with the print cylinder 112 to the printing position.

Sequencing of the printer 31 in order to provide sequential serialization of the numbers printed on the check is automatic (much like that of an odometer) and inherent in the function of commercially available printers comtemplated for use with this invention. Thus, each number on a print cylinder 112 is mechanically incremented by one before it arrives for printing a serial number on the check.

Printer 32 functions identically as printer 31 except that its inker would contain magnetic ink for the printing of MICR on the check.

Although this embodiment describes a printer with ten print cylinders 112, some other number could be provided. A particular advantage of the use of ten print cylinders 112 is that the units wheel of the print cylinders can be fixed since it prints a constant number. Therefore, the first actuating pawl of the numbering unit can be in the tens column. This will result in extended life of the numbering print cylinder. It may be desirable to provide separate edge detectors e.g. **18*b* and 18*b* in FIG. 2 in advance of the printers 32 and 33**, utilizing separate AND circuits and printer indexer controls for each printer to provide independent operation thereof.

In any event, the placement of the edge detectors is critical only as it relates to the initiation, speed and timing of the printers which are matters of engineering design.

Logo printer 33 differs from printers 31 and 32 in that it does not use printing cylinders having sequencing print wheels. A single plate or ten individual plates containing ten identical logo impressions is carried by the printer 33 in place of the print cylinders.

The above described embodiment should not be construed as limiting the present invention in any way other than as limited by the claims which follow:

What is claimed is:

1. A document processor, comprising in combination;

transport means for moving documents serially along a path including, an impression drum, a transfer drum having a portion of its periphery contiguous to a portion of the periphery of said impression drum, motor means for rotating said impression drum in the clockwise direction and said transfer drum in the counterclockwise direction, singler means for feeding documents serially onto said transfer drum, means for retaining documents on said transfer drum and said impression drum over a portion of their peripheries and for transferring documents from said transfer drum to said impression drum in the contiguous area of their peripheries, flaw detection means disposed adjacent said path for detecting flaws in said documents, printing means disposed adjacent said path for printing selectable indicia on said documents, control means connected to said printing means responsive to said flaw detection means preventing said printing means from printing on flawed documents.

2. A document processor according to claim 1 wherein said flaw detection means comprises;

first scanning means disposed adjacent the document path on the periphery of said transfer drum for detecting flaws on one side of said document, second scanning means disposed adjacent the document path on the periphery of said impression drum for detecting flaws on the other side of said document.

3. A document processor according to claim 2 wherein said printing means comprises;

at least one printer disposed adjacent the document path on the periphery of said impression drum at a point on said path after said second scanning means for printing serialized numbers on each document.

4. A document processor according to claim 3 wherein said control means comprises;

edge detector means disposed adjacent the document path on the periphery of said impression drum between said second scanning means and said printer, printer control means, AND circuit means having an output connected to said printer control means and an input from said flaw detection means and said edge detector means for causing said printer to print only on unflawed documents.

5. A document processor according to claim 4 wherein said printer comprises a drum having a plurality of equally spaced print cylinders disposed about its periphery and, said printer control means includes indexer means for indexing said printer for causing a next print cylinder to be moved into printing position with said impression drum at the same peripheral speed of said impression drum and in synchronism with a document on said impression drum moving into said printing position.

* * * * *